US008189837B2

(12) United States Patent
Baechler

(10) Patent No.: US 8,189,837 B2
(45) Date of Patent: May 29, 2012

(54) HEARING SYSTEM WITH ENHANCED NOISE CANCELLING AND METHOD FOR OPERATING A HEARING SYSTEM

(75) Inventor: Herbert Baechler, Meilen (CH)

(73) Assignee: Phonak AG, Staefa (CH)

( * ) Notice: Subject to any disclaimer, the term of this patent is extended or adjusted under 35 U.S.C. 154(b) by 368 days.

(21) Appl. No.: 12/518,936

(22) PCT Filed: Dec. 15, 2006

(86) PCT No.: PCT/EP2006/069742

§ 371 (c)(1),
(2), (4) Date: Jun. 12, 2009

(87) PCT Pub. No.: WO2008/071236

PCT Pub. Date: Jun. 19, 2008

(65) Prior Publication Data

US 2009/0268933 A1 Oct. 29, 2009

(51) Int. Cl.
*H04R 25/00* (2006.01)

(52) U.S. Cl. ..... 381/318; 381/312; 381/317

(58) Field of Classification Search ..... 381/23.1, 381/60, 312, 315–318, 320
See application file for complete search history.

(56) References Cited

U.S. PATENT DOCUMENTS

2004/0131201 A1 7/2004 Hundal et al.

FOREIGN PATENT DOCUMENTS

| | | | |
|---|---|---|---|
| GB | 2319690 | A | 5/1998 |
| JP | 59-095797 | A | 6/1984 |
| WO | 2005-048648 | A2 | 5/2005 |

OTHER PUBLICATIONS

Levitt, "Noise Reduction in Hearing Aids: A Review", Journal of Rehabilitation Research and Development, vol. 38, No. 1, Jan./Feb. 2001, pp. 111-121.
Written Opinion for PCT/EP2006/069742, dated Jun. 16, 2009.

*Primary Examiner* — Suhan Ni
(74) *Attorney, Agent, or Firm* — Pearne & Gordon LLP

(57) ABSTRACT

The hearing system (1) comprises a filtering unit (6) for improving a signal-to-noise ratio of an S+N-audio signal (S+N) composed of a desired audio signal (S) and a unwanted audio signal (N), which filtering unit (6) comprises an adaptive filter;

an S+N-input for receiving said S+N-audio signal (S+N);

an N*-input for receiving an N*-audio signal (N*), which is used as an estimate for said unwanted audio signal (N); and an S*-output for outputting an S*-audio signal (S*) obtained in dependence of said S+N-audio signal (S+N) and said N*-audio signal (N*), which is an approximation towards said desired signal (S);

wherein the hearing system (1) comprises a selecting unit (2) operationally connected to said filtering unit (6) for selecting a first input audio signal (In1; In2; . . . ) from at least two input audio signals (In1, In2) and feeding said first input audio signal (In1; In2) either to said S+N-input or to said N*-input. Preferably, said selecting unit (2) is adapted to selecting also a second input audio signal (In2) from said at least two input audio signals (In1, In2), which is different from said first input audio signal (In1), and said first input audio signal (In1) is fed to said S+N-input, and said second input audio signal (In2) is fed to said N*-input.

26 Claims, 4 Drawing Sheets

HEARING SYSTEM WITH ENHANCED NOISE CANCELLING AND METHOD FOR OPERATING A HEARING SYSTEM

TECHNICAL FIELD

The invention relates to a hearing system, to an adaptive noise canceller and to a method for operating a hearing system.

A hearing system comprises at least one hearing device.

Typically, a hearing system comprises, in addition, at least one additional device, which is operationally connected to said hearing device, e.g., another hearing device, a remote control or a remote microphone.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

BACKGROUND OF THE INVENTION

In the field of hearing devices, and in particular of hearing-aid devices, noise cancelling is an important issue, because background noise greatly damages speech intelligibility for a user of a hearing device.

One known way of cancelling noise in a signal composed of a desired signal plus an unwanted signal (noise signal), which interferes with said desired signal, makes use of an adaptive filter, which is a filter that keeps adjusting itself. A corresponding a noise canceller is referred to as adaptive noise canceller.

From "Noise reduction in hearing aids: An overview", Harry Levitt, Journal of Rehabilitation Research and Development, Vol. 38 No. 1, January/February 2001, p. 111-121, an adaptive noise canceller is known, which receives at one input a signal from a speech-and-noise microphone and at another input a signal from a noise microphone. The signal from said noise microphone is fed to an adaptive filter and subtracted from the signal from said speech-and-noise microphone. Thereupon, the adaptive noise canceller can output a signal, which is close to the desired speech signal (speech, with noise subtracted, at least approximately).

Many adaptive filters are known in the art and used for noise cancelling. The LMS (least means square) adaptive filtering algorithm, for example, has been developed more than 45 years ago by Widrow and Hoff.

It is desirable to provide for an improved noise cancellation.

SUMMARY OF THE INVENTION

Therefore, one object of the invention is provide for an improved noise cancellation. A hearing system, a noise canceller, and a method for operating a hearing system shall be provided, which provide for an improved noise cancellation.

Further objects emerge from the description and embodiments below.

At least one of these objects is at least partially achieved by apparatuses and methods according to the patent claims.

The method for operating a hearing system comprising a filtering unit for improving a signal-to-noise ratio of an S+N-audio signal composed of a desired audio signal and an unwanted audio signal, which filtering unit comprises an adaptive filter, comprises the steps of

- feeding said S+N-audio signal to an S+N-input of said filtering unit;
- feeding an N*-audio signal to an N*-input of said filtering unit, which N*-audio signal is used as an estimate for said unwanted audio signal;
- using said filtering unit for obtaining an S*-audio signal in dependence of said S+N-audio signal and said N*-audio signal, which S*-audio signal is an approximation towards said desired signal;
- outputting said S*-audio signal from an S*-output of said filtering unit;
- selecting a first input audio signal from at least two input audio signals; and
- using said first input audio signal as said S+N-audio signal or as said N*-audio signal.

Through this, an improved noise cancellation can be achievable. The invention provides for a new degree of freedom in noise cancellation, because at least one input of the filtering unit is not fixedly connected to the source of an input audio signal, but the input audio signal to be fed to said at least one input can be selected out of at least two input audio signals.

The invention can be particularly advantageous when the location of sound sources (of desired or unwanted sound) is not fix, but changes, e.g., when a sound source moves, or when a source of desired sound becomes a source of unwanted sound (noise) and/or a source of noise becomes a source of desired sound, as it may happen in a discussion involving several people.

An audio signal is an electrical signal, of analogue and/or digital type, which represents an acoustic signal.

Today's hearing systems frequently comprise more than two input transducer units, wherein an input transducer unit is defined to comprise at least one input converter, in particular at least one acoustic-to-electric converter. In the case of a hearing system with more than two input transducer units, the invention enables to choose, which one of the more than two input transducer units shall provide for the input audio signal used as S+N-audio signal or as N*-audio signal.

It would, e.g., be possible to fixedly assign one input transducer unit to the S+N-input, e.g., a microphone worn by a speaker, and to choose from a number of differently positioned further input transducer units that one further input transducer unit, which represents best the noise in the S+N-audio signal, so that an optimized S*-audio signal can be derived by means of the filtering unit.

Vice versa, it would, e.g., be possible to fixedly assign one input transducer unit to the N*-input, e.g., a microphone positioned on a table around which several speakers are seated, and to choose from a number of further input transducer units, each worn by a different speaker, that one further input transducer unit, which is worn by the currently speaking speaker. Also this way, an optimized S*-audio signal can be derived.

Said selecting unit allows for different ways of routing input audio signals to the inputs of the filtering unit. Therefore, said selecting unit can also be referred to as a signal routing unit.

The adaptive filter may implement any possible adaptive filtering algorithm, e.g., the LMS algorithm of Widroff and Hoff or others. Many adaptive filters use a certain number of narrow-band bandfilters, single bands of which are selectively emphasized or suppressed in dependence of the input audio signals.

Considered under a slightly different point of view, which emphasizes the correlation between the audio signals and the corresponding acoustic signals (also referred to as acoustic waves, sound waves or sound), a hearing system according to the invention can be characterized as comprising a filtering unit for improving a signal-to-noise ratio of an S+N-audio signal representative of an acoustic signal composed of a desired acoustic signal interfered by an unwanted acoustic signal, which filtering unit comprises an adaptive filter;

an S+N-input for receiving said S+N-audio signal;

an N*-input for receiving an N*-audio signal representative of an acoustic signal approximately corresponding to said unwanted acoustic signal; and an S*-output for outputting an S*-audio signal obtained in dependence of said S+N-audio signal (S+N) and said N*-audio signal (N*), which is representative of an approximation towards said desired acoustic signal;

wherein the hearing system comprises a selecting unit operationally connected to said filtering unit for selecting a first input audio signal from at least two input audio signals and feeding said first input audio signal either to said S+N-input or to said N*-input.

In a very advantageous embodiment of the invention, the method comprises the steps of selecting a second input audio signal from said at least two input audio signals, which is different from said first input audio signal; and using said first input audio signal as said S+N-audio signal; and using said second input audio signal as said N*-audio signal.

In this embodiment, both, the input audio signal fed to the S+N-input, and the input audio signal fed to the N*-input, are selected from the at least two input audio signals. E.g., if exactly two input audio signals are available, it is possible to choose their assignment to the S+N-input and N*-input, respectively.

E.g., in a binaural hearing system comprising two hearing devices, each comprising one input transducer unit, one worn at the user's left ear, the other worn at the user's right ear, it can be advantageous to (re-)assign the audio signal generated by the hearing devices to the S+N- and N*-input, respectively, depending on which side of the user a speaker is located.

In one embodiment, the hearing system comprises at least one input transducer unit, which is a remote input transducer unit. A remote input transducer unit is an input transducer unit, which can be positioned remote from the hearing system user's head during normal operation of the hearing system, e.g., a hand-held microphone. This allows to have a large distance between at least two input transducer units, which results in largely uncorrelated input audio signals and, accordingly, in an enhanced noise cancellation.

In one embodiment, at least one of said at least two input transducer units is an input transducer unit of a mobile communication device. E.g., the microphone or microphones of a mobile phone and/or Bluetooth headsets for hands-free communication can be used for generating input audio signals.

Mobile communication devices, like, e.g., mobile phones or personal digital assistants, are today widely used and most of them comprise a microphone and a standardized wireless short-range communication interface like, e.g., Bluetooth or USB. When a hearing system comprises—at least in one device of the hearing system—a compatible interface, it is possible to integrate such a mobile communication device in the hearing system and thus take advantage of the great availability of the mobile communication devices for augmenting the hearing system, at least temporarily.

In one embodiment, the method comprises the step of transmitting, at least partially in a wireless fashion, input audio signals from at least one of said at least two input transducer units to a device of said hearing system, in which said selecting of input audio signals takes place.

The wireless transmission may make use of any suitable technology, e.g., Bluetooth technology or proprietary technologies.

In addition or alternatively, a wirebound connection between devices of the hearing system, and in particular between at least one input transducer unit and said selecting unit, may be provided for.

In one embodiment, at least one of said at least two input transducer units comprises at least two acoustic-to-electric converters and—operationally connected therero—a beam forming unit, and the method comprises the step of using said beam forming unit for obtaining at least one of said at least two input audio signals.

Accordingly, a beam-formed input audio signal is provided.

We understand under technical beam forming (in this application also simply referred to as beam forming) a tailoring of the amplification of an audio signal with respect to an acoustic signal as a function of direction of arrival of the acoustic signal relative to a predetermined spatial direction. Customarily, the beam characteristic is represented in form of a polar diagram scaled in dB.

Most generically, technical beam forming is always achieved when the output audio signals of two spaced-apart input transducers (also referred to as input acoustic-to-electric converters) are processed to result in a combined output audio signal.

Beam forming is well known in the art. In conjunction with the invention, it may be used, e.g., for deriving an S+N-audio signal with a particularly high content of desired signal.

Usually, each of said at least two input audio signals is obtained from one of at least two input transducer units of the hearing system, preferably from different input transducer units. It is possible that one input transducer unit provides for two or more input audio signals, in particular, when the input transducer unit comprises more than one acoustic-to-electric converter.

In one embodiment, said selecting of input signals is controlled in dependence of input from the user of the hearing system. This may allow the user to successively select different assignments of input audio signals to the S+N- and the N*-inputs and finally select that assignment which results in the most-preferred audible signal. This allows for a manual optimization of noise cancellation.

In one embodiment, the method comprises the steps of analyzing at least one of said at least two input audio signals; and controlling said selecting of input signals in dependence of the result of said analysis.

This allows for an automatic optimization of noise cancellation. It is possible to dynamically select an input signal for at least one input of the filtering unit.

Various techniques for suitable analyses are known to the person skilled in the art. For example, the analyzing comprises at least one of classifying said at least one of said at least two input audio signals according to a set of classes each of which describes a predetermined acoustic environment; and estimating a signal-to-noise-ratio of said at least two input audio signals;

evaluating speech intelligibility of at least one of said at least two input audio signals, in particular estimating an articulation index of at least one of said at least two input audio signals;

determining a direction of arrival of sound of at least one of said at least two input audio signals.

Classification of current environments according to a set of classes each of which describes a predetermined acoustic environment is known for an automatic selection of hearing programs in digital hearing-aid devices. In conjunction with the invention, one or preferably all input audio signals can be classified in a way known in the art—simultaneously or successively—wherein the result of the classification can be used for the decision of which input audio signal to assign to which input of the filtering unit.

In one embodiment, said hearing system comprises at least a second filtering unit comprising an adaptive filter, and said method comprises the steps of feeding a third of said at least two input audio signals to an S+N-input of said second filtering unit;

feeding a fourth of said at least two input audio signals, which is different from said third input audio signal, to an N*-input of said filtering unit;

using said second filtering unit for obtaining an S*-audio signal in dependence of said third and fourth of said at least two input audio signals;

outputting said S*-audio signal from an S*-output of said second filtering unit;

controlling said selecting of input signals in dependence of the S*-audio signals output from said S*-outputs of said at least two filtering units.

In this embodiment, an input audio signal is fed to an S+N- or an N*-input of said second filtering unit, which is different from the input audio signal fed to the corresponding input of the other filtering unit. It is possible to compare and/or analyze the so-obtained two S*-audio signals and to thereupon provide the user with the S*-audio signal which is considered best-suited or with a signal derived therefrom. Said third of said at least two input audio signals may be identical with said first or said second of said at least two input audio signals; and said fourth of said at least two input audio signals may be identical with said first or said second of said at least two input audio signals.

In one embodiment, the method comprises the step of obtaining at least one, preferably at least two, of said input audio signals by signal splitting. Details of corresponding embodiments will be given below in this application.

According to the invention, an adaptive noise canceller for improving a signal-to-noise ratio of an S+N-audio signal composed of a desired audio signal and a unwanted audio signal, comprises at least two signal inputs for receiving one of at least two input signals each, wherein a first of said at least two input audio signals is used as said S+N-audio signal, and a second of said at least two input audio signals is used as an N*-audio signal, which N*-audio signal is used as an estimate for said unwanted audio signal;

an S*-output for outputting an S*-audio signal, which is an approximation towards said desired signal, and which is obtained in dependence of said S+N-audio signal and said N*-audio signal; and a selecting unit for selecting at least one of said first and said second input audio signals from said at least two input audio signals.

In a very advantageous embodiment of the adaptive noise canceller, said selecting unit is adapted to selecting both, said first and said second input audio signals from said at least two input audio signals.

In particular, adaptive noise cancellers for use in a device of a hearing system are envisaged.

The advantages of the hearing systems and the adaptive noise cancellers according to the invention correspond to the advantages of corresponding methods.

Further preferred embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. The described embodiments are meant as examples and shall not confine the invention.

DETAILED DESCRIPTION OF THE INVENTION

Figure 1:
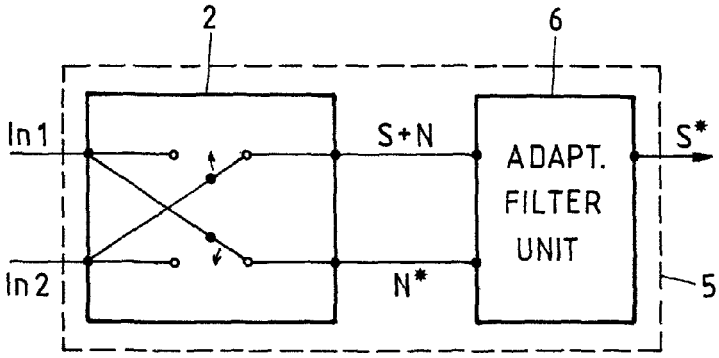
FIG. 1 a diagram illustrating an adaptive noise canceller according to the invention.

FIG. 1 illustrates in a schematic diagram of an adaptive noise canceller 5 according to the invention. It comprises a selecting unit 2 and, operationally connected thereto, a filtering unit 6. The filtering unit 6 comprises an adaptive filter and receives two input audio signals: an S+N-audio signal and an N*-audio signal. The S+N-audio signal, also referred to as primary signal, is composed of a desired signal and an unwanted signal, the latter also referred to as noise or noise signal. The N*-audio signal is an audio signal, which approximately corresponds to said noise signal or resembles said noise signal, and which is used as an estimate for said noise signal. It is also referred to as noise reference.

By means of the adaptive filter, an S*-audio signal is obtained from said S+N-audio signal and said N*-audio signal. The S*-audio signal is an approximation towards said desired signal.

The selecting unit 2 receives two input audio signals In1, In2 and allows to select, which of the two input audio signals In1, In2 will be fed to the filtering unit 6 as S+N-audio signal and which will be fed to the filtering unit 6 as N*-audio signal. A selecting unit 2 may be realized in any form, e.g., using switches, in particular in digital form.

It has been found that it can be very valuable to be able to do such a selection, because in certain acoustic situations, it is not obvious, which of two or more input audio signals has to be used as S+N-audio signal and which has to be used as N*-audio signal when the best noise cancellation shall be achieved.

Since the selecting unit 2 of FIG. 1 receives only two input audio signals (In1, In2), it allows to choose only between two states: either In1 is used as S+N-audio signal, while In2 is used as N*-audio signal, or In2 is used as S+N-audio signal, while In1 is used as N*-audio signal.

An adaptive noise canceller according to the invention can be arranged in any device of a hearing system.

Figure 2:
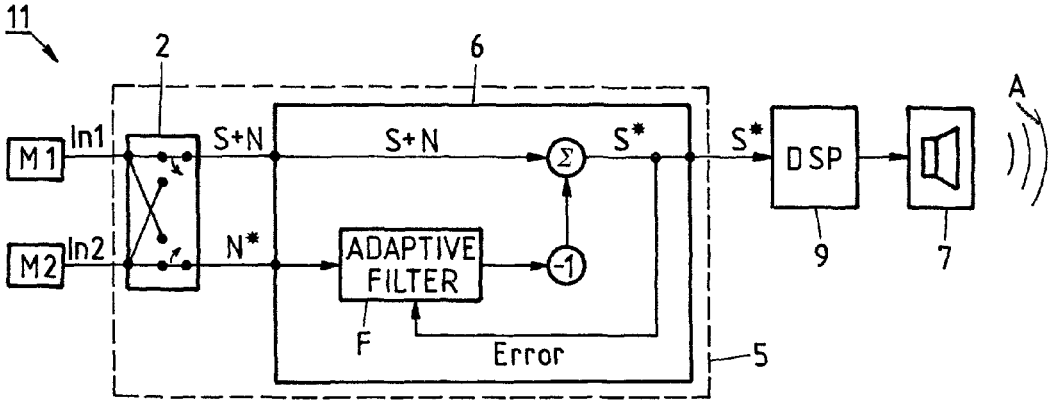
FIG. 2 a diagram illustrating a hearing device according to the invention.

FIG. 2 is a diagrammatical illustration of a hearing device 11 according to the invention comprising an adaptive filter 5 as described in conjunction with FIG. 1, wherein the filtering unit 6 is drawn in more detail. The hearing device 11 furthermore comprises two input transducer units M1, M2, a signal processor 9 and an output transducer unit 7, e.g., a loudspeaker, also referred to as receiver. M1 can, e.g., be a directional microphone and M2 can, e.g., be an omnidirectional microphone. By means of M1 and M2, acoustic sound waves (also referred to as acoustic signals) are converted into audio signals In1 and In2, respectively. These are fed to the selecting unit 2, which feeds In1 to the S+N-input of filtering unit 6 and In2 to the N*-input of filtering unit 6 or vice versa.

The schematic illustration of the filtering unit 6 shows that the noise reference (N*) is fed to the adaptive filter F, the output of which is subtracted from the primary signal (S+N). The resulting S*-audio signal is output from the filtering unit 6 and used as an error-signal for the adaptive filter F. The S*-audio signal, which is expected to have an improved signal-to-noise ratio with respect to In1 and In2, will usually be processed further in the signal processor 9 before the result thereof is fed to the output transducer unit 7.

Furthermore, it is possible that the audio signals output from the input transducer units M1, M2 are subjected to some signal processing before becoming the S+N- and N*-audio signals used in the filtering unit 6 (not shown).

The signal processor 9 is usually adapted to take individual hearing needs and preferences of the hearing device user into account. This is in particular the case when the hearing device 11 is a hearing-aid device.

The output transducer unit 7 may comprise an electrical-to-mechanical converter generating acoustic signals (sound waves) or exciting parts of the user's hearing, and/or may comprise an electrical-to-electrical converter for exciting parts of the user's hearing. Whatever signal the output transducer unit 7 generates, it will be considered an audible signal A, since it is to be perceived by the hearing of the user, regardless of being acoustic signals, mechanical force or electrical voltage.

Figure 3:
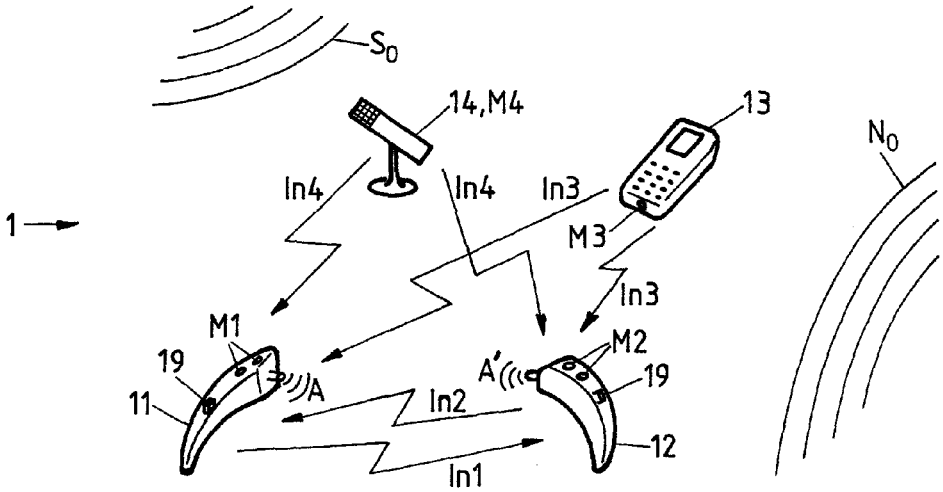
FIG. 3 a diagram illustrating a hearing system.

FIG. 3 is a diagram illustrating a hearing system 1, comprising two hearing devices 11, 12, a mobile communication device 13 and a remote microphone 14. All these devices 11, 12, 13, 14 of the hearing system 1 are operationally interconnected, preferably, as indicated in FIG. 3, in a wireless fashion. Each of them comprises an input transducer unit M1, M2, M3, M4, respectively. The input audio signals In1, In2, In3, In4, obtained by means of the respective input transducer unit M1, M2, M3, M4, are transmitted to at least one of the hearing devices 11,12; in FIG. 3 to each of the two hearing devices 11,12.

Each of the two hearing devices 11, 12 generates an audible signal A, A', and preferably, each of the two hearing devices 11, 12 comprises an adaptive noise canceller according to the invention. A user interface 19 may be foreseen at least one of the hearing devices 11, 12, e.g., in form of a knob, which allows the hearing device user to manually select between different routings of input audio signals to an S+N- and an N*-input of a filtering unit. The optimum choice and the optimum noise cancellation will depend on the input transducer units M1, M2, M3, M4 and on their position in the sound field composed of desired acoustic signal $S_0$ and unwanted (noise) acoustic signal $N_0$.

Both, the mobile communication device 13 and the remote microphone 14 have the advantage that they can be positioned at a location remote from the user's head, i.e., remote from the hearing devices 11, 12 worn by the hearing system user. Positioning two input transducer units, from which the S+N- and the N*-inputs of an adaptive noise canceller are fed, in a great distance from each other, is of great advantage for the noise cancelling, because of the low correlation of the so-derived input audio signals. For example, devices 13 and/or 14 could be positioned far away from devices 11 and 12, either close to a source of desired sound, e.g., attached to a speaker, or somewhere where noise prevails. In the latter case, a source of desired sound could be picked up using a closely focused beam-formed audio signal in at least one of the hearing devices 11, 12.

In case of a binaural hearing system 1 with a left hearing device 11 and a right hearing device 12, the corresponding input transducer units M1, M2 are—under normal operating conditions—positioned not very remote from each other. But due to the head shadow effect, it is nevertheless possible to achieve a good noise cancellation when using audio signals derived from these input transducer units M1, M2 as input audio signals In1, In2 to a selecting unit and filtering unit as described above.

Figure 4:
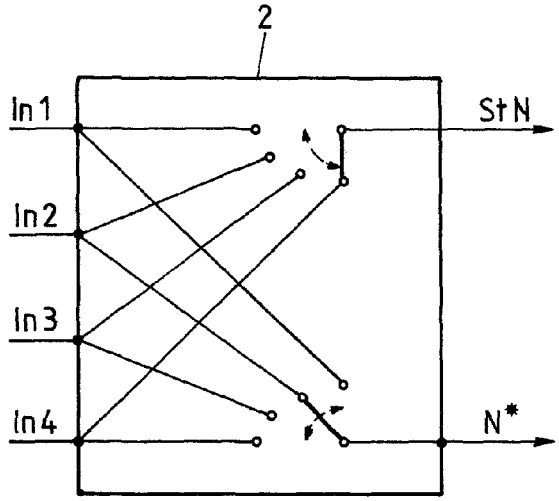
FIG. 4 an illustration of a selecting unit capable of selecting from four input audio signals.

FIG. 4 is an illustration of a selecting unit 2 capable of selecting from four input audio signals In1, In2, In3, In4, as it may be used in case of a hearing system 1 like shown in FIG. 3. Any choice of one input audio signal to be fed to the S+N-input of the filtering unit 6 and another input audio signal to be fed to the N*-input of the filtering unit 6 can be made. Of course, similar selecting units for routing n input audio signals (with $n \geqq 2$) onto m inputs of a filtering unit with $m \geqq 2$ inputs are readily constructed.

Figure 5:
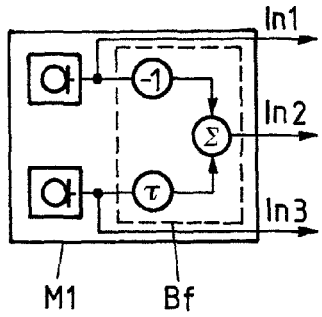
FIG. 5 an illustration of an input transducer unit generating three input audio signals.

FIG. 5 is an illustration of an input transducer unit 5 generating three input audio signals In1, In2, In3. This is to illustrate that one input transducer unit may be capable of providing for not only one, but several input audio signals. The input transducer unit M1 of FIG. 5 comprises two acoustic-to-electric converters, the output of which is output as In1 and In3, respectively. In addition, an input audio signal In2 is output, which is obtained by means of beam forming unit Bf, e.g., in a way known in the art, namely by the delay-and-subtract method well-known in the field of beam forming.

Figure 6:
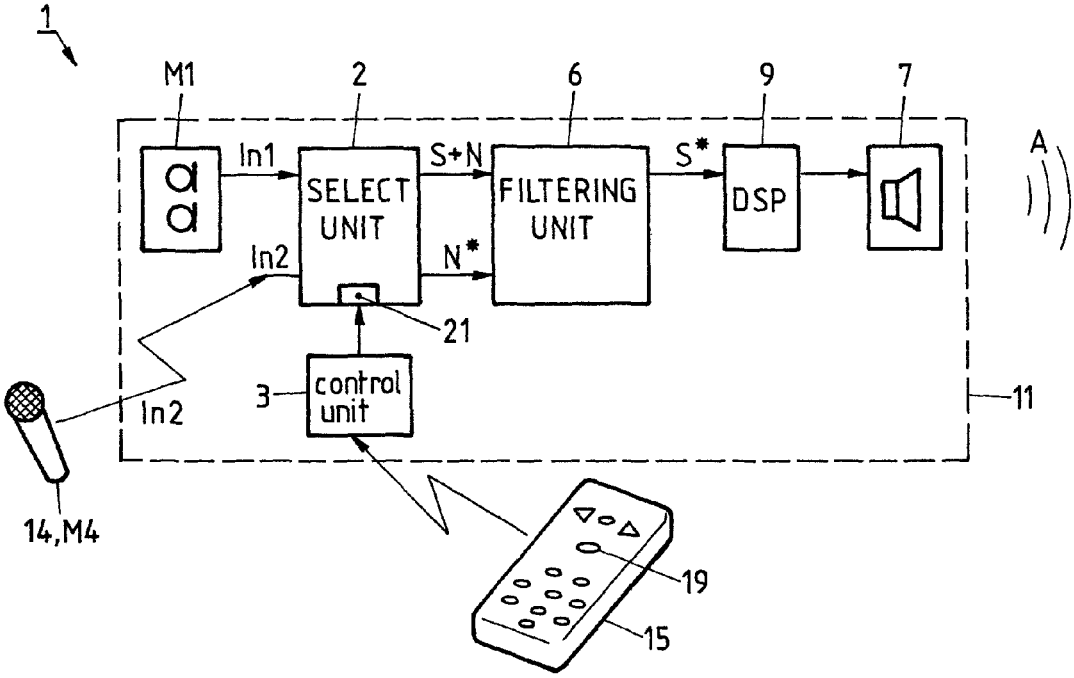
FIG. 6 an illustration of a hearing system according to the invention, with remote microphone and remote control.

FIG. 6 is an illustration of a hearing system 1 comprising a hearing device 11, a remote microphone constituting a remote input transducer unit 14 and a remote control 15. Most parts of this hearing system 1 have already been described in conjunction with FIGS. 2 and 3. But the selecting unit 2 has a control input 21 and is controlled by a control unit 3. The control unit 3 is operationally connected to said remote control 15, which has a user interface comprising a user control 19 by means of which the user can select different routings of input audio signals In1, In2 to the two inputs of the filtering unit 6.

Figure 7:
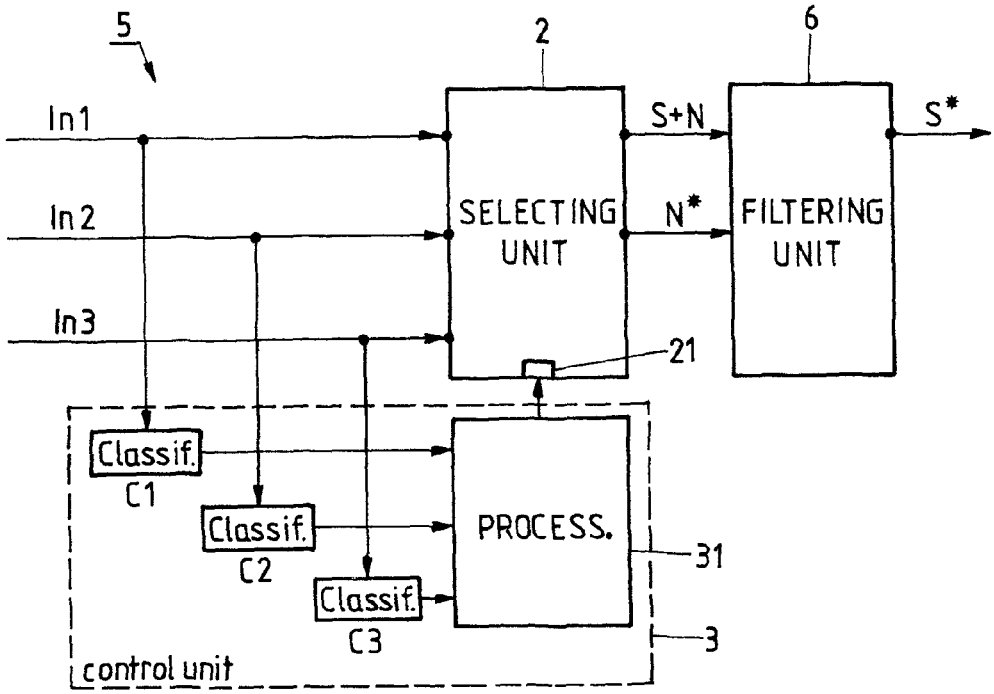
FIG. 7 an illustration of an adaptive noise canceller with a control unit using classifiers.

FIG. 7 is an illustration of an adaptive noise canceller 5 with a control unit 3 using classifiers C1, C2, C3. Despite of having to let the user manually choose different signal routings until a well-suited hearing sensation is achieved, like in the embodiment of FIG. 6, the embodiment of FIG. 7 allows for a dynamic and automatic optimization of the signal routing accomplished by selecting unit 2.

The control unit 3 of the embodiment of FIG. 7 comprises one classifier C1; C2; C3 per input audio signal In1; In2; In3 and a processor 31. Each of the classifier classifies one input audio signal according to a set of predetermined classes. Classification is well-known in the field of hearing device, in particular in the field of hearing-aid devices.

In a simple example, each classifier may derive a value indicative of the similarity between the current acoustic scene as reflected in the respective input audio signal In1; In2; In3 obtained by the respective input transducer unit and the predetermined acoustic scene described by the corresponding class, e.g., "pure speech", "speech in noise", "noise only" and "music" or other classes. From the so-derived values, the processor 31 derives, which signal routing in selecting unit 2 is the most promising one for an optimum noise cancelling. If, e.g., input audio signal In1 has a value indicating a high similarity to class "speech in noise" and lower values for similarity to the other classes, and input audio signal In2 has a value indicating a high similarity to class "music" and lower values for similarity to the other classes, and input audio signal In3 has a value indicating a high similarity to class "pure noise" and lower values for similarity to the other classes, control unit 3 will advise selecting unit 2 to route input audio signal In1 to the S+N-input of filtering unit 6 and input audio signal In3 to the N*-input of filtering unit 6. Of course, decision schemes much more elaborate than sketched in this simple example may be implemented. And other types of signal analysis than classification may be implemented, e.g., signal-to-noise ratio determination, speech intelligibility analysis (e.g. by articulation index), determination of the direction of arrival of sound using (e.g., using a beamformer), or others.

Figure 8:
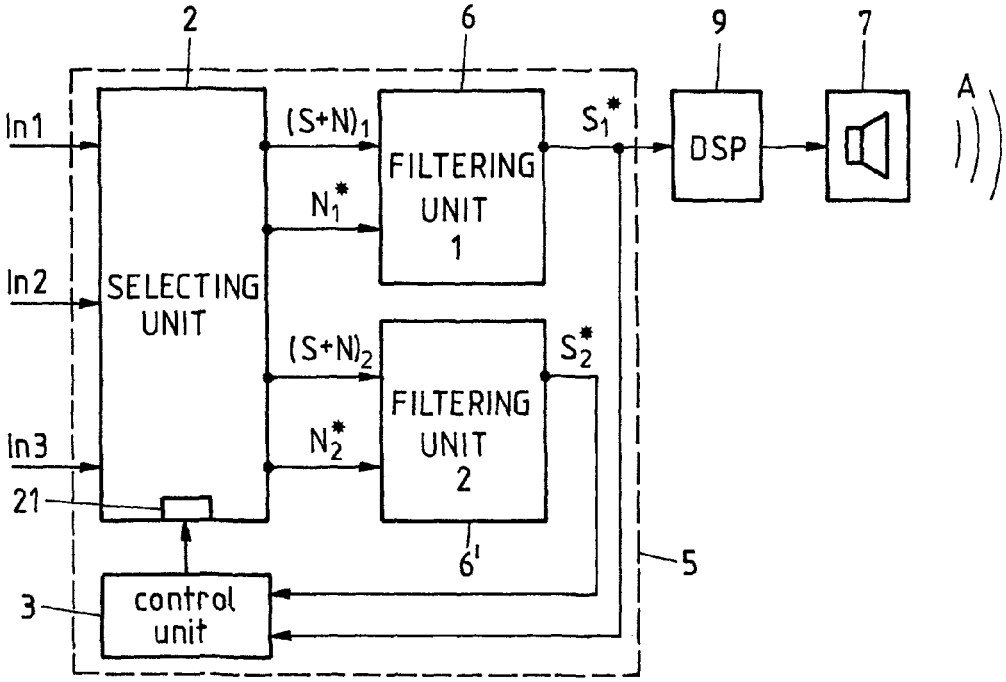
FIG. 8 an illustration of a detail of a hearing device according to the invention with a control unit and two filtering units.

FIG. 8 is an illustration of a detail of a hearing device with a control unit 3 and two filtering units 6, 6'. In this embodiment, two S*-audio signals $S^*_1$,$S^*_2$ are generated, each one by means of one filtering unit (6 or 6'), wherein the inputs of the filtering units 6 and 6' are fed with a different combination of input audio signals. Both S*-audio signals $S^*_1$,$S^*_2$ are used as inputs for the control unit 3, so that an optimized noise cancellation can be achieved based on the comparison of said S*-audio signals $S^*_1$,$S^*_2$.

It is also possible to steadily automatically vary the signal routing to the second filtering unit 6' and store corresponding data, e.g., the so-obtained $S^*_2$-audio signals and/or results of an analysis of these. Based on these data, an optimized routing may be found, which can then be used for routing input signals to filtering unit 6. Instead of trying out different routings in a purely sequential fashion, it is also possible to implement several filtering units, which work simultaneously, and feed them with different combinations of the available input signals. From analyzing the corresponding S*-audio signals, it is possible to steadily check, which routing would provide for an optimum noise cancellation, and adjust the selecting unit 2 accordingly, i.e., use the optimized routing for deriving the S*-audio signal, which is used as basis for the audible signals A to be perceived by the user.

In one embodiment, at least one, preferably all of the input audio signals are derived from audio signals, which are obtained by input transducer units, by signal splitting and separate noise cancelling in audio signal components obtained by said signal splitting. A signal splitting of an audio signal splits up the audio signal into two or more audio signal components. For example, an audio signal may be split up into two or more components, each only containing frequencies in a certain frequency band. Other criteria for dividing an audio signal into components are known to the person skilled in the art and can, of course, be used, too. After a separate noise cancelling in audio signal components fulfilling different criteria, the resulting (component-based) S*-audio signals will typically be combined again for obtaining one final S*-audio signal.

Preferably, the same criterion (or criteria) for splitting is (are) used for all audio signals from which input audio signals to be fed to a selecting unit are possibly derived. And all audio signal components fulfilling the same criterion (or criteria) are preferably fed to the same selecting unit, so that these audio signal components can only be fed to the same filtering unit.

Figure 9:
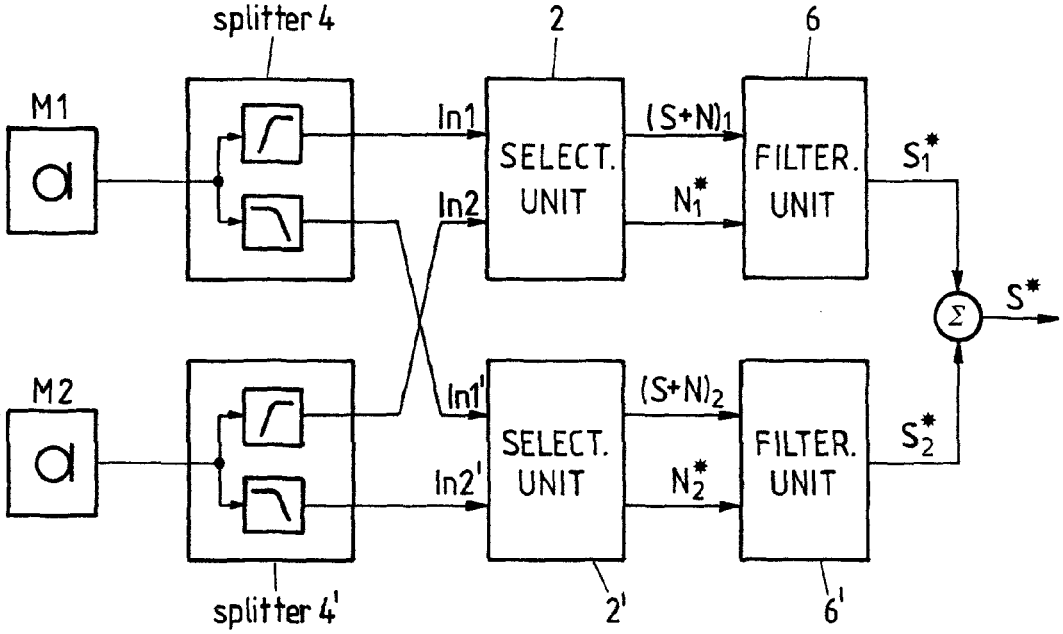
FIG. 9 an illustration of a detail of a hearing device according to the invention with signal splitting.

FIG. 9 is an illustration of a detail of a hearing device according to the invention with such a signal splitting. Audio signals from input transducer units M1 and M2 are fed to a splitting unit 4 and a splitting unit 4', respectively. In splitting units 4,4', the audio signals are split, e.g., as indicated in FIG. 9, in dependence of frequency, e.g., by means of a highpass and a lowpass filter. The lowpass filtered components of the audio signals are fed from splitting units 4 and 4', respectively, to selecting unit 2 as input audio signals In1 and In2, respectively. And the highpass filtered components of the audio signals are fed from splitting units 4 and 4', respectively, to selecting unit 2' as input audio signals In1' and In2', respectively. In selecting unit 2, the assignment of In1 and In2 to S+N-audio signal $(S+N)_1$ and N*-audio signal $N_1$* is made, which are fed to filtering unit 6 for obtaining S*-audio signal $S_1$*. And in selecting unit 2', the assignment of In1' and In2' to S+N-audio signal $(S+N)_2$ and N*-audio signal $N_2$* is made, which are fed to filtering unit 6' for obtaining S*-audio signal $S_2$*. The S*-audio signal $S_1$* and $S_2$* are then combined again for obtaining S*-audio signal S*. This advanced way of adaptive filtering can, of course, well be combined with or applied to embodiments described above, in particular embodiments with control units 3.

It is to be noted, that various units and parts drawn in the Figures are merely logic units, in particular 2, 3, 4, 4', 5, 6, 6, 9, 21, 31, C1, C2, C3, F, M1, M2, M3, M4. They may be implemented in various ways, e.g., all in one processor chip or distributed over a number of processors; in one or several pieces of software and so on.

LIST OF REFERENCE SYMBOLS

1 hearing system
2 selecting unit
3 control unit
4, 4' splitting unit, signal splitter
5 adaptive noise canceller
6, 6' filtering unit
7 output transducer unit
9 signal processing unit, signal processor, digital signal processor, DSP
11 hearing device
12 hearing device
13 remote microphone
14 mobile communication device, mobile phone
15 remote control
19 user interface, user control, knob
21 control input
31 processor
A, A' audible signal
Bf beam forming unit
C1, C2, C3 signal analyzing units, classifiers
F adaptive filter
In1, In2, . . . input audio signals
M1, M2, . . . input transducer units
N noise audio signal $N^*$, $N^*_1$, $N^*_2$ N*-audio signal
$N_0$ noise acoustic signal
S desired audio signal
$S^*$, $S^*_1$, $S^*_2$ S*-audio signal
$S_0$ desired acoustic signal
S+N, $(S+N)_1$, $(S+N)_2$ S+N-audio signal

What is claimed is:

1. Hearing system (1) comprising a filtering unit (6) for improving a signal-to-noise ratio of an S+N-audio signal (S+N) composed of a desired audio signal (S) and a unwanted audio signal (N), which filtering unit (6) comprises an adaptive filter (F);

an S+N-input for receiving said S+N-audio signal (S+N);

an N*-input for receiving an N*-audio signal (N*), which is used as an estimate for said unwanted audio signal (N); and an S*-output for outputting an S*-audio signal (S*) obtained in dependence of said S+N-audio signal (S+N) and said N*-audio signal (N*), which is an approximation towards said desired signal (S);

characterized in comprising a selecting unit (2) operationally connected to said filtering unit (6) for selecting a first input audio signal (In1; In2; . . . ) from at least two input audio signals (In1, In2, . . . ) and feeding said first input audio signal (In1; In2; . . . ) either to said S+N-input or to said N*-input.

2. The system (1) according to claim 1, wherein said selecting unit (2) is adapted to selecting a second input audio signal (In2) from said at least two input audio signals (In1, In2, . . . ), which is different from said first input audio signal (In1), and feeding said first input audio signal (In1) to said S+N-input and feeding said second input audio signal (In2) to said N*-input.

3. The system (1) according to claim 1, comprising at least two input transducer units (M1, M2, . . . ) each comprising at least one acoustic-to-electric converter, wherein each of said at least two input audio signals (In1, In2, . . . ) is obtained from one of said at least two input transducer units (M1, M2, . . . ).

4. The system (1) according to claim 3, wherein at least one (14) of said at least two input transducer units (M1, M2, . . . ) is a remote input transducer unit (M4).

5. The system (1) according to claim 3, wherein at least one (14) of said at least two input transducer units (M1, M2, . . . ) is an input transducer unit (M3) of a mobile communication device (13).

6. The system (1) according to claim 3, wherein an at least partially wireless transmission of input audio signals (In1, In2, . . . ) from at least one of said at least two input transducer units (M1, M2, . . . ) to said selecting unit (2) is possible.

7. The system (1) according to claim 3, wherein at least one of said at least two input transducer units (M1, M2, . . . ) comprises at least two acoustic-to-electric converters and operationally connected therero a beam forming unit (Bf).

8. The system (1) according to, claim 1, which comprises a control unit (3) for controlling said selecting of input signals (In1; In2; . . . ) in said selecting unit (2).

9. The system (1) according to claim 8, comprising a user interface for receiving input from a user of the hearing system (1), wherein said control unit (3) is operationally connected to said user interface and said selecting of input signals (In1; In2; . . . ) in said selecting unit (2) is controlled in dependence of said input from said user.

10. The system (1) according to claim 8 , wherein said control unit (3) comprises at least one signal analyzing unit (C1; C2; . . . ) for analyzing at least one of said at least two input audio signals (In1, In2, . . . ), wherein said selecting of input signals (In1; In2; . . . ) in said selecting unit (2) is controlled in dependence of the result of said analysis.

11. The system (1) according to claim 10, wherein said at least one signal analyzing unit (C1; C2; . . . ) is selected from the group comprising classifier (C1; C2; . . . );

unit capable of estimating a signal-to-noise-ratio of a signal;

a unit capable of evaluating speech intelligibility, in particular a unit capable of estimating an articulation index;

a unit capable of determining a direction of arrival of sound.

12. The system (1) according to claim 8, comprising at least a second filtering unit (6') comprising an adaptive filter (F);

an S+N-input for receiving a third of said at least two input audio signals (In1, In2, . . . );

an N*-input for receiving a fourth of said at least two input audio signals (In1, In2, . . . ); and an S*-output for outputting an S*-audio signal ($S^*_2$) obtained in dependence of said third and fourth of said at least two input audio signals (In1, In2, . . . );

wherein said S*-audio signals ($S^*_1$, $S^*_2$) output from said S*-outputs of said at least two filtering units (6,6') are fed to said control unit (3) and used for controlling said selecting of input signals (In1; In2; . . . ) in said selecting unit (2).

13. Adaptive noise canceller (5) for improving a signal-to-noise ratio of an S+N-audio signal (S+N) composed of a desired audio signal (S) and a unwanted audio signal (N), comprising at least two signal inputs for receiving one of at least two input signals (In1, In2, . . . ) each, wherein a first (In1; In2; . . . ) of said at least two input audio signals (In1, In2, . . . ) is used as said S+N-audio signal (S+N),and a second (In2; In1; . . . ) of said at least two input audio signals (In1, In2, . . . ) is used as an N*-audio signal (N*), which N*-audio signal (N*) is used as an estimate for said unwanted audio signal (N); and an S*-output for outputting an S*-audio signal (S*), which is an approximation towards said desired signal (S), and which is obtained in dependence of said S+N-audio signal (S+N) and said N*-audio signal (N*);

characterized in comprising a selecting unit (2) for selecting at least one of said first (In1; In2; . . . ) and said second (In2; In1; . . . ) input audio signals from said at least two input audio signals (In1, In2, . . . ).

14. The adaptive noise canceller (5) according to claim 13 wherein said selecting unit (2) is adapted to selecting both, said first (In1; In2; . . . ) and said second (In2; In1; . . . ) input audio signals from said at least two input audio signals (In1, In2, . . . ).

15. Method for operating a hearing system (1) comprising a filtering unit (6) for improving a signal-to-noise ratio of an S+N-audio signal (S+N) composed of a desired audio signal (S) and a unwanted audio signal (N), which filtering unit (6) comprises an adaptive filter (F), said method comprising the steps of feeding said S+N-audio signal (S+N) to an S+N-input of said filtering unit (6);

feeding an N*-audio signal (N*) to an N*-input of said filtering unit (6), which N*-audio signal (N*) is used as an estimate for said unwanted audio signal (N);

using said filtering unit (6) for obtaining an S*-audio signal (S*) in dependence of said S+N-audio signal (S+N) and said N*-audio signal (N*), which S*-audio signal (S*) is an approximation towards said desired signal (S);

outputting said S*-audio signal (S*) from an S*-output of said filtering unit (6);

characterized by the steps of selecting a first input audio signal (In1; In2; . . . ) from at least two input audio signals (In1, In2, . . . ); and using said first input audio signal (In1; In2; . . . ) as said S+N-audio signal (S+N) or as said N*-audio signal (N*).

16. The method according to claim 15, comprising the steps of selecting a second input audio signal (In2) from said at least two input audio signals (In1, In2, . . . ), which is different from said first input audio signal (In1); and using said first input audio signal (In1) as said S+N-audio signal (S+N); and using said second input audio signal (In2) as said N*-audio signal (N*).

17. The method according to claim 15, comprising the step of obtaining each of said at least two input audio signals (In1, In2, . . . ) from one of at least two input transducer units (M1, M2, . . . ) of said hearing system (1).

18. The method according to claim 17, wherein at least one (14) of said at least two input transducer units (M1, M2, . . . ) is a remote input transducer unit (M4).

19. The method according to claim 17, wherein at least one (14) of said at least two input transducer units (M1, M2, . . . ) is an input transducer unit (M3) of a mobile communication device (13).

20. The method according to claim 17, comprising the step of transmitting, at least partially in a wireless fashion, input audio signals (In1, In2, . . . ) from at least one of said at least two input transducer units (M1, M2, . . . ) to a device (11;12) of said hearing system (1), in which said selecting of input audio signals (In1,In2, . . . ) takes place.

21. The method according to claim 17, wherein at least one of said at least two input transducer units (M1, M2, . . . ) comprises at least two acoustic-to-electric converters and operationally connected therero a beam forming unit (Bf), said method comprising the step of using said beam forming unit (Bf) for obtaining at least one of said at least two input audio signals (In1, In2, . . . ).

22. The method according to claim 15, comprising the step of controlling said selecting of input signals (In1; In2; . . . ) in dependence of input from the user of the hearing system (1).

23. The method according to claim 15, comprising the steps of analyzing at least one of said at least two input audio signals (In1, In2, . . . ); and controlling said selecting of input signals (In1; In2; . . . ) in dependence of the result of said analysis.

24. The method according to claim 23, wherein said analyzing comprises at least one of classifying said at least one of said at least two input audio signals (In1, In2, . . . ) according to a set of classes each of which describes a predetermined acoustic environment; and estimating a signal-to-noise-ratio of said at least two input audio signals (In1, In2, . . . );

evaluating speech intelligibility of at least one of said at least two input audio signals (In1, In2, . . . ), in particular estimating an articulation index of at least one of said at least two input audio signals (In1, In2, . . . );

determining a direction of arrival of sound of at least one of said at least two input audio signals (In1, In2, . . . ).

25. The method according to claim 15, wherein said hearing system (1) comprises at least a second filtering unit (6') comprising an adaptive filter, said method comprising the steps of feeding a third of said at least two input audio signals (In1, In2, . . . ) to an S+N-input of said second filtering unit (6');

feeding a fourth of said at least two input audio signals, which is different from said third input audio signal, (In1, In2, . . . ) to an N*-input of said filtering unit (6);

using said second filtering unit (6') for obtaining an S*-audio signal ($S^*_2$) in dependence of said third and fourth of said at least two input audio signals (In1, In2, . . . );

outputting said S*-audio signal ($S^*_2$) from an S*-output of said second filtering unit (6');

controlling said selecting of input signals (In1; In2; . . . ) in dependence of the S*-audio signals ($S^*_2$, $S^*_2$) output from said S*-outputs of said at least two filtering units (6,6').

26. Method for manufacturing an audible signal by means of a hearing system (1) comprising a filtering unit (6) for improving a signal-to-noise ratio of an S+N-audio signal (S+N) composed of a desired audio signal (S) and a unwanted audio signal (N), which filtering unit (6) comprises an adaptive filter (F), said method comprising the steps of feeding said S+N-audio signal (S+N) to an S+N-input of said filtering unit (6);

feeding an N*-audio signal (N*) to an N*-input of said filtering unit (6), which N*-audio signal (N*) is used as an estimate for said unwanted audio signal (N);

using said filtering unit (6) for obtaining an S*-audio signal (S*) in dependence of said S+N-audio signal (S+N) and said N*-audio signal (N*), which S*-audio signal (S*) is an approximation towards said desired signal (S);

outputting said S*-audio signal (S*) from an S*-output of said filtering unit (6);

deriving said audible signal from said S*-audio signal (S*);

characterized by the steps of selecting a first input audio signal (In1; In2; . . . ) from at least two input audio signals (ml, In2, . . . ); and using said first input audio signal (In1; In2; . . . ) as said S+N-audio signal (S+N) or as said N*-audio signal (N*).

* * * * *